US005381749A

United States Patent [19]

Larson

[11] Patent Number: 5,381,749

[45] Date of Patent: Jan. 17, 1995

[54] BOAT MOORING HOOK

[76] Inventor: Virgil A. Larson, 971 W. Rockaway La., Camano Island, Wash. 98292

[21] Appl. No.: 116,881

[22] Filed: Sep. 7, 1993

[51] Int. Cl.[6] ..... B63B 21/54

[52] U.S. Cl. ..... 114/221 R; 114/230

[58] Field of Search ..... 114/230, 221 R; 294/19.1, 82.17

[56] References Cited

U.S. PATENT DOCUMENTS

| | | | |
|---|---|---|---|
| 960,070 | 5/1910 | Brown | 294/19.1 X |
| 1,281,336 | 10/1918 | Frazier, Jr. | 294/19.1 |
| 1,426,220 | 8/1922 | Sajtar | 294/19.1 |
| 2,677,911 | 5/1954 | Fink | 294/19.1 |
| 2,821,766 | 2/1958 | Moosman | 294/82.17 X |
| 3,098,462 | 7/1963 | Holzman | 294/84 |
| 3,774,953 | 11/1973 | Babcock | 294/19.1 |
| 3,891,165 | 6/1975 | Day et al. | 244/137 R |
| 4,793,646 | 12/1988 | Michaud, Jr. | 294/19.1 |
| 4,932,700 | 6/1990 | Hart | 294/19.1 |
| 5,116,260 | 5/1992 | Upchurch | 114/230 |
| 5,190,330 | 3/1993 | Dunham | 294/19.1 |

*Primary Examiner*—Sherman Basinger
*Attorney, Agent, or Firm*—Christensen, O'Connor, Johnson & Kindness

[57] ABSTRACT

An apparatus for mooring a boat (14) to a mooring structure (16, 38) with the aid of a rod (18) and mooring line (20) is disclosed. The apparatus includes a U-shaped securing member (10, 12) having a top portion (22), a bottom portion (26), and a middle portion (24). The U-shaped securing member is arranged and configured for at least partially surrounding a portion of the mooring structure to provide moorage thereto. The distance between the top portion and the bottom portion of the securing member provides close-fitting engagement with the mooring structure. An eve (30) is affixed to the top portion of the securing member for attachment to the mooring line. A rod-receiving sleeve (34) is also attached to the top portion of the securing member adjacent the eve. The rod-receiving sleeve is for receiving the end of the rod and properly aligning the U-shaped securing member such that the open gap between the top portion and the bottom portion faces the mooring structure. In one preferred embodiment of the invention, the mooring structure includes a buoy ring (36). In this embodiment, the distance between the top portion and the bottom portion of the securing member is substantially the same as the thickness of the buoy ring. In another preferred embodiment of the present invention, the mooring structure includes a dock rail (38). In this embodiment, the distance between the top portion of the securing member and the bottom portion of the securing member is substantially the same as the thickness of the dock rail.

22 Claims, 4 Drawing Sheets 18
20a
32a
30a
34a
22a
10
24a
26a
28a
36
16

14
18
20a
32a
30a
34a
22a
10
24a
26a
28a
36
16

BOAT MOORING HOOK

BOAT MOORING HOOK

1. Field of the Invention

This invention relates to equipment for mooring boats, and more particularly, to mooring hooks for mooring a boat to a buoy or dock.

2. Background of the Invention

Pleasure boats, such as yachts and small boats, are often moored to either a dock rail or a mooring buoy. The mooring line is tied around the dock rail or through a mooring ring on a buoy. Reaching the dock rail or the buoy to tie the mooring line can be difficult. In the case of the dock rail, at least two persons are usually necessary; one person jumps onto the dock to tie the mooring line while another remains aboard to pilot the boat. In the case of the buoy, one person pilots the boat while the second reaches down for the buoy and pulls it up to tie the line. If the buoy cannot be pulled up, due to factors such as its weight or tension in its anchor line, the second person must reach down to the buoy while tying the line.

These procedures can present real difficulties and even hazards to a boater. An unassisted boater may even find it impossible to moor his boat. Reaching over the side of the boat to a buoy may be dangerous, especially in rough waters (a time when the buoy anchor line is likely to be in tension such that the buoy cannot be lifted). Jumping off a boat to moor it to a dock may not be advisable when currents or wind can easily carry the boat away.

Attempts have been made at procedures for mooring a boat to a buoy utilizing the additional reach provided by a standard boat hook. For example, U.S. Pat. No. 4,932,700 to Hart (the "Hart patent"), discloses a shackle having a spring-biased pin to extend through a mooring ring when the boat hook is removed from the shackle (see FIG. 5 of the Hart patent). This device may be difficult to use in many instances. For example, a mooring ring that is not situated in a rigid upright position or rough waters can make positioning of the shackle over the mooring ting difficult. The boat hook may inadvertently be knocked off the shackle. The Hart shackle may also be expensive since it has moving parts and must withstand severe environmental conditions. The Hart patent makes no disclosure of a device to aid in mooring a boat to a dock.

The limitations of the above-described mooring-line shackle are typical of the current designs. The present invention was developed to effectively address the problem of easy, safe moorage of a boat to either a buoy or a dock rail with the use of a mooring line and a boat hook or similar rod, by one unassisted person.

SUMMARY OF THE INVENTION

The present invention overcomes the problems outlined above and provides a safe and convenient mooring hook for mooring a boat to a mooring structure with the aid of a rod and a mooring line. The apparatus of the invention includes a U-shaped securing member, an eye, and a rod-receiving sleeve. The U-shaped securing member is arranged and configured for at least partially surrounding a portion of the mooring structure to provide moorage thereto. The securing member has a first end and a second end, and an open side between the first and second ends. The distance between the first and second ends provides close-fitting engagement with the mooring structure. The eye extends from the first end of the securing member. The mooring line is attached to the eye. The rod-receiving sleeve is attached to the securing member adjacent the eye and is for receiving the end of the boat hook and properly aligning the U-shaped securing member such that the open side faces the mooring structure.

One embodiment of the present invention includes a mooring structure configured to accommodate a buoy ting. In this embodiment, the distance defined by the open side between the first end and the second end of the securing member is substantially the same as the thickness of the buoy ting. The U-shaped securing member has a top portion, a middle portion extending downwardly from the top portion, and a bottom portion extending back from the middle portion. The smallest distance between the top portion and the bottom portion (i.e., the gap) is substantially the same width as the buoy ring for close-fitting engagement therewith. The eye extends from the top portion of the securing member. The rod-receiving sleeve is attached to the top portion of the securing member. The sleeve has an inner shape matching the outer shape of one end of the rod for removable engagement therewith. In the preferred embodiments of the invention, the securing member includes ribs extending inwardly from the inside perimeter of the securing member. The longitudinal axis of the sleeve is substantially transverse to the longitudinal axis of the top portion of the securing member. The bottom portion of the securing member includes a slight downward bend. The sleeve is disposed adjacent the eye at the end of the top portion of the securing member opposite the middle portion.

In alternate embodiments of the invention the gap between the top and bottom portions is slightly narrower than the thickness of the mooring structure, be it the buoy ring or the dock rail. The bottom portion of the securing member elastically bends slightly away from the top portion as the securing member is placed on the mooring structure.

A preferred embodiment of the invention adapted for mooring the boat to the dock rail is used with the aid of a rod and mooring line. This embodiment of the invention includes a U-shaped securing member, an eye extending from the top portion of the securing member, and a rod-receiving sleeve attached to the top portion of the securing member. In this embodiment, the gap between the top portion and the bottom portion is substantially the same width as the thickness of the dock rail for close-fitting engagement therewith.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figures 1, 2:
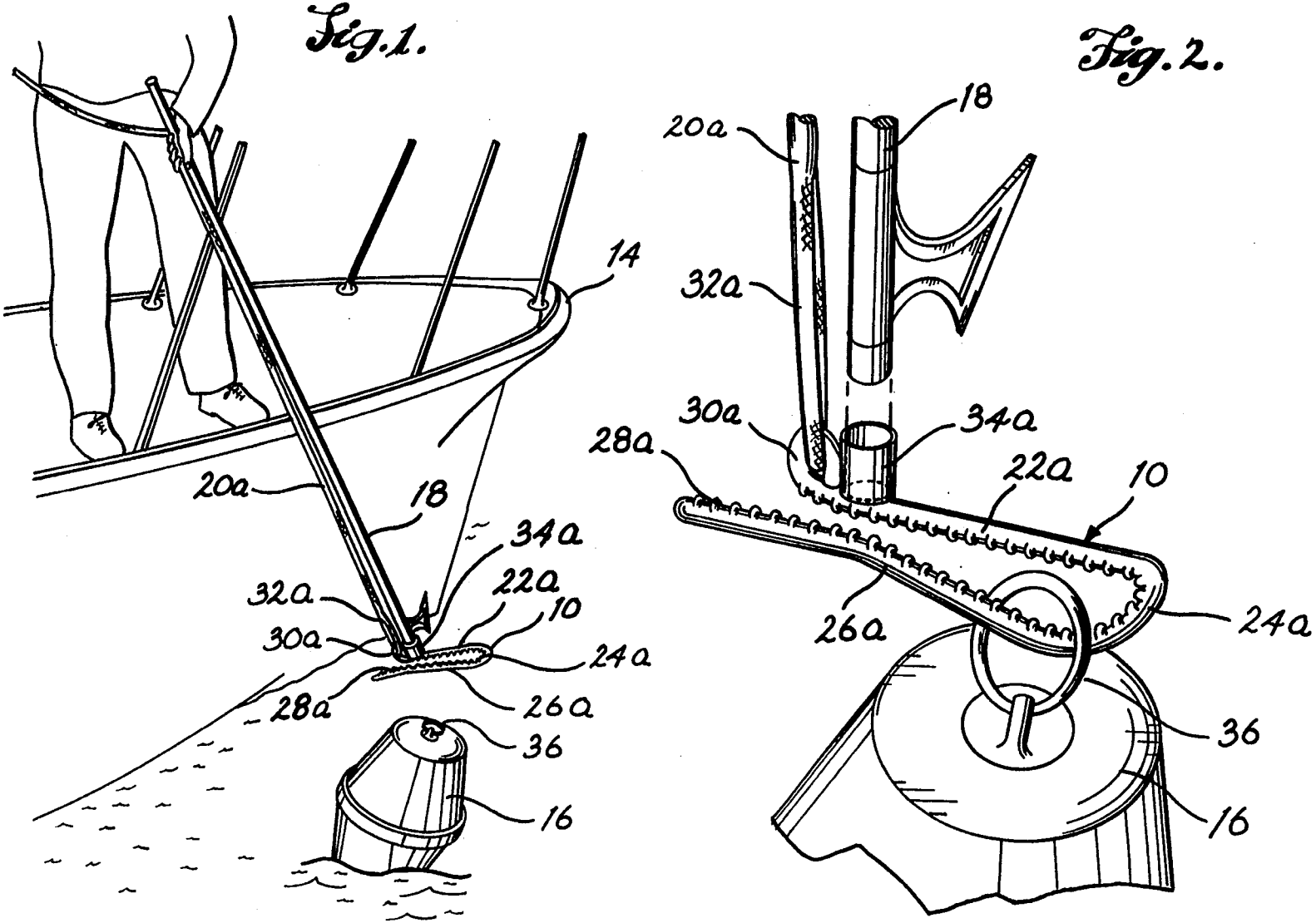
FIG. 1 is a perspective view of the invention, showing its use in mooring a boat to a buoy.
FIG. 2 is a perspective view of the buoy hook of the present invention, illustrating the removal of the boat hook after the buoy hook has been engaged through the buoy ring.

Referring first to FIG. 1, a preferred embodiment of the present invention will be described. The invention includes a buoy hook 10 used to secure a boat 14 to a buoy 16. A standard boat hook 18, along with mooring line 20*a*, is used to position and secure buoy hook 10 to buoy 16 in order to moor boat 14, at least temporarily. Boat hook 18 is a standard boat hook having a long rod with a hook near one end. Boat hook 18 is a type conventionally used for many chores associated with boating. With the present invention, a rod not having a hook near one end would also function as desired to moor boat 14 with buoy hook 10.

Figure 3:
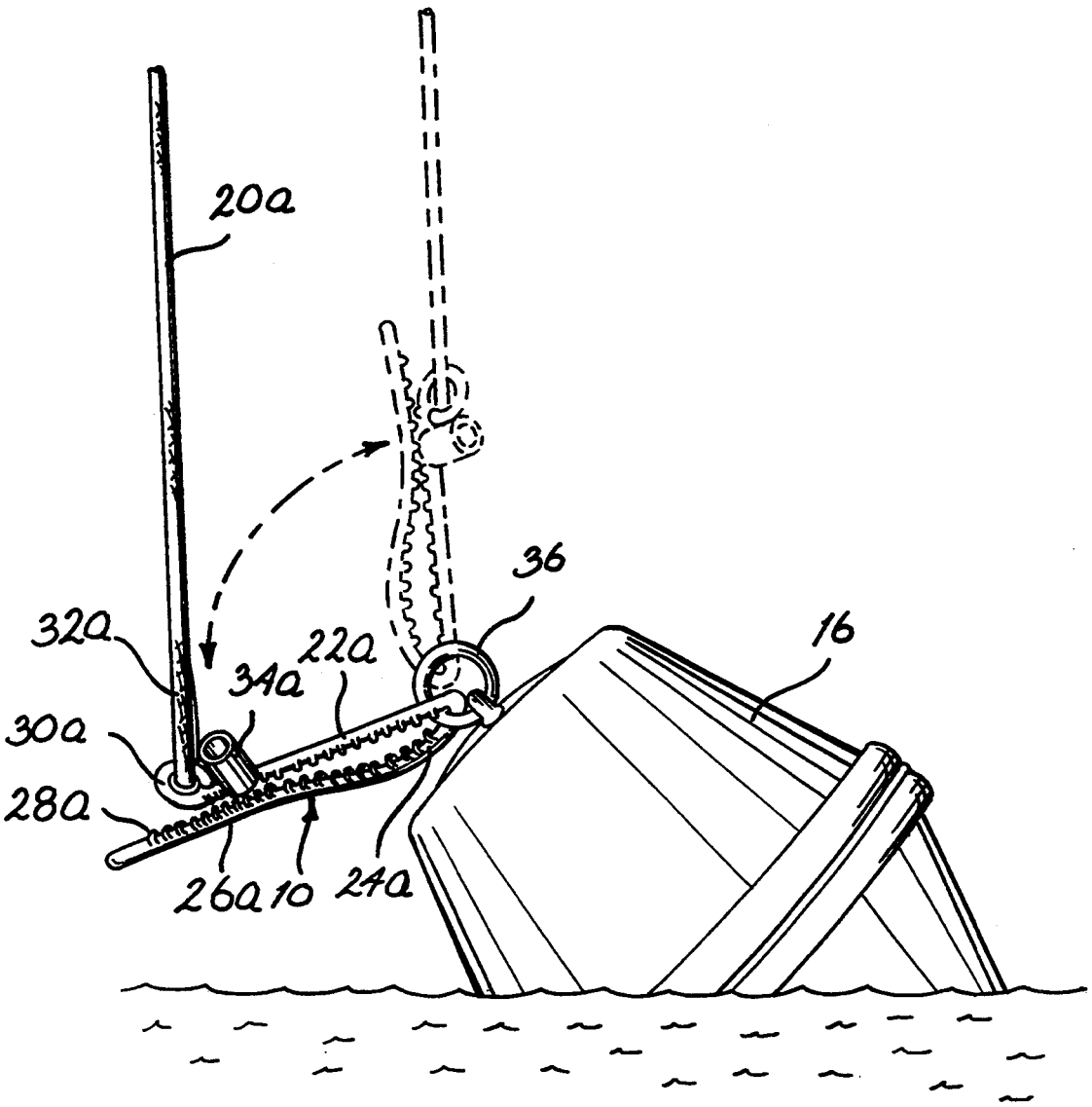
FIG. 3 is a perspective view of the buoy hook, illustrating the movement of the buoy hook when the level of the buoy changes with respect to the level of the boat.

As seen in FIGS. 1, 2, and 3, buoy hook 10 has generally a U-shaped configuration. Buoy hook 10 is preferably constructed of stainless steel bent into the U-shaped configuration. Buoy hook 10 includes a substantially linear top portion 22*a*, a curved middle portion 24*a*, forming the bottom of the U-shape, and a bottom portion 26*a* having a slight downward bend in its midsection. Bottom portion 26*a* extends generally linearly from middle portion 24*a* in a direction toward the end of top portion 22*a*. As bottom portion 26*a* nears the end of top portion 22*a*, bottom portion 26*a* bends slightly away from top portion 22*a*. The middle of the bend forms the narrowest gap between top portion 22*a* and bottom portion 26*a*. Bottom portion 26*a* continues a small distance past the end of top portion 22*a*. Thus, the narrowest gap is between the slight bend in bottom portion 26*a* and the end of top portion 22*a*, the interior opening or spacing between top and bottom portions 22*a* and 26*a* being wider than at the gap. As mentioned above, buoy hook 10 is formed in generally a U-shape. The exact configuration of the U-shape can be altered while still falling within the scope of the invention. For example, a more bulbous U-shape could be used, or a U-shape with one leg of the U being considerably longer than the other could be used. Various other U-shapes having opposing side portions joined by a central portion, a gap being defined between the free ends of the side portions could be used.

Spaced-apart, transversely oriented ribs 28*a* project from the inner surfaces of top, middle, and bottom portions 22*a*, 24*a*, and 26*a*, respectively, of buoy hook 10. Ribs 28*a* increase the sliding friction and, thus, the resistance to sliding of buoy hook 10 on buoy 16.

An eye 30*a* is formed in the end of top portion 22*a* opposite middle portion 24*a*. Eye 30*a* forms a closed loop for securement to mooring line 20*a* Preferably, mooring line 20*a* is spliced into itself in an eye splice 32*a* for permanent securement to buoy hook 10. Alternatively, mooring line 20*a* could be secured to buoy hook 10 with a simple knot.

A tubular sleeve 34 is affixed adjacent eye 30 on top portion 22*a*. Sleeve 34*a* has an inner diameter matching the outside diameter of the end of boat hook 18 for engagement therewith. Sleeve 34*a* is preferably welded onto top portion 22*a*. Sleeve 34*a* has a longitudinal axis that is generally transverse to the longitudinal axis of top portion 22*a*. Preferably, the angle between the longitudinal axis of sleeve 34*a* and the segment of top portion 22*a* between sleeve 34*a* and middle portion 24*a* is approximately 120 degrees. This angle of 120 degrees facilitates the positioning of buoy hook 10 with boat hook 18, since typically boat hook 18 will be extended away from boat 14 at an angle to reach buoy 16. Other angles may be used. For example, sleeve 34 may even extend in a direction perpendicular to top portion 22*a*.

Buoy hook 10 is used by sliding the end of boat hook 18 within tubular sleeve 34*a*. Tension in mooring line 20*a* in the direction of the other end of boat hook 18 is maintained until buoy hook 10 is placed on buoy 16, such that buoy hook 10 remains on the end of boat hook 18. Buoy hook 10 can then be moved over the side of boat 14 and positioned over buoy 16. Buoy 16 includes a buoy ring 36 through which ropes are typically secured for mooring boats. Bottom portion 26*a* of buoy hook 10 is slid beneath buoy ring 36 to lift buoy ring 36. Obviously, if buoy ring 36 is permanently in an upright position, it is simply necessary to advance the end of bottom portion 26*a* through buoy ring 36 without first sliding bottom portion 26*a* beneath buoy ring 36 to lift buoy ring 36.

Buoy hook 10 is advanced through buoy ring 36 by the boater's moving boat hook 18 while still aboard boat 14. Once buoy hook 10 is engaged on buoy ring 36, boat hook 18 can be removed from sleeve 34*a*. Preferably, the gap in buoy hook 10, the narrow passage between top portion 22*a* and bottom portion 26*a*, is substantially the same width as the diameter of a cross section of buoy ring 36. The gap presents unobstructed passage to entry of buoy ring 36 (except for any force required to slightly flex buoy hook 10 as explained below). No snap hooks or other structures need to be moved before or during coupling of buoy hook 10 to buoy ring 36. Alternatively, an interference fit could be obtained with the gap, such that bottom portion 26*a* elastically bends outwardly away from top portion 22*a* as buoy ring 36 passes between top portion 22*a* and bottom portion 26*a* at the narrowest portion of gap between the two.

Referring specifically to FIG. 3, the position of buoy hook 10 after boat hook 18 is removed is shown. Middle portion 24*a* is not as heavy as the end of top portion 22*a* of buoy hook 10 where eye 30*a* and sleeve 34*a* are located. Therefore, as wave action changes the vertical and horizontal position of boat 14 relative to buoy 16, buoy hook 10 pivots downwardly as shown in FIG. 3. Ribs 28 help to keep buoy hook 10 from simply sliding through buoy ring 36, such that disengagement is avoided. Mooring line 20*a* also tends to pull buoy hook 10 away from buoy ring 36 such that no disengagement is likely to occur. Buoy hook 10 may be used for long-term moorage. However, an extra measure of safety is provided when leaving boat 14 by simpl an extra securing line through buoy ring 36.

Buoy hook 10 provides several advantages to the user when mooring the boat. Buoy hook 10 is economical to buy and use since it is of simple construction with no moving parts and nothing to replace. The boater has no need to leave the boat to secure the boat to buoy 16. Nor does the boater need to reach down over the edge of the boat to grasp buoy 16 for tying with a rope. Buoy hook 10 can be fastened to either small or large buoy tings regardless of the position of the ring.

Figure 4:
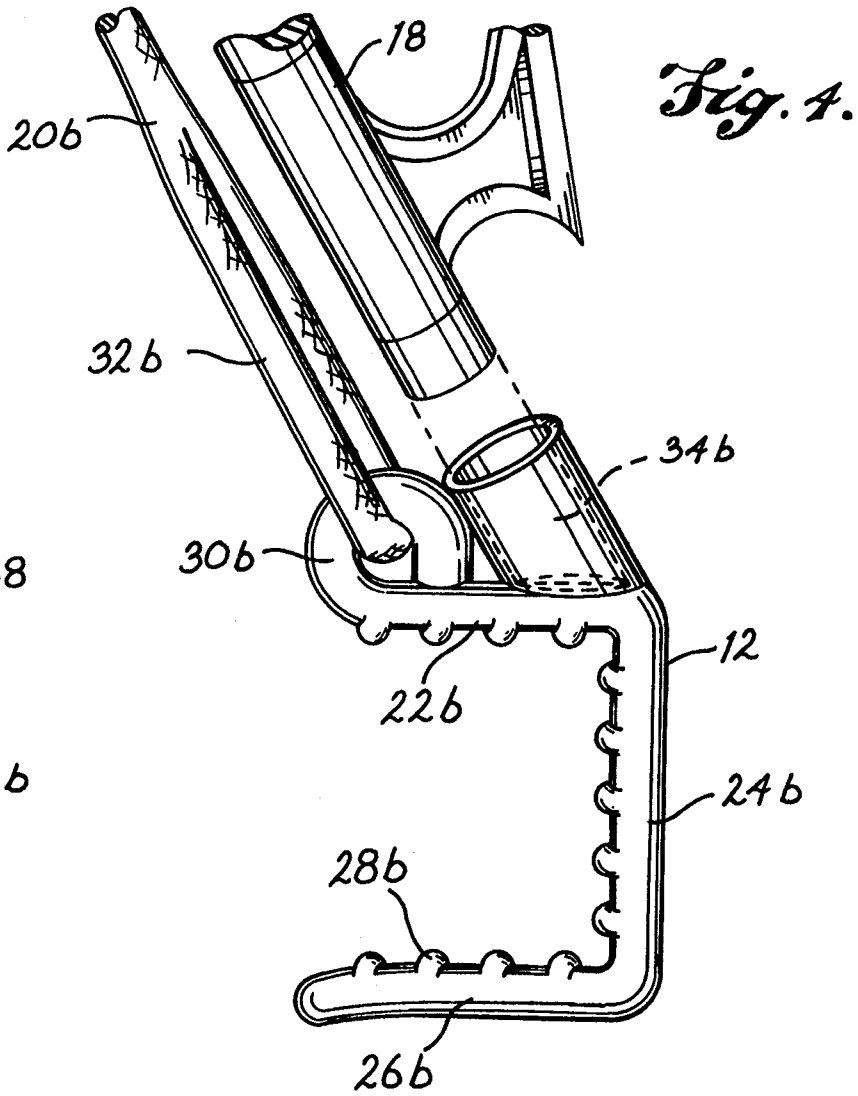
FIG. 4 is a side elevational view of an alternate embodiment of the present invention, illustrating the details of a dock hook.
Figure 5:
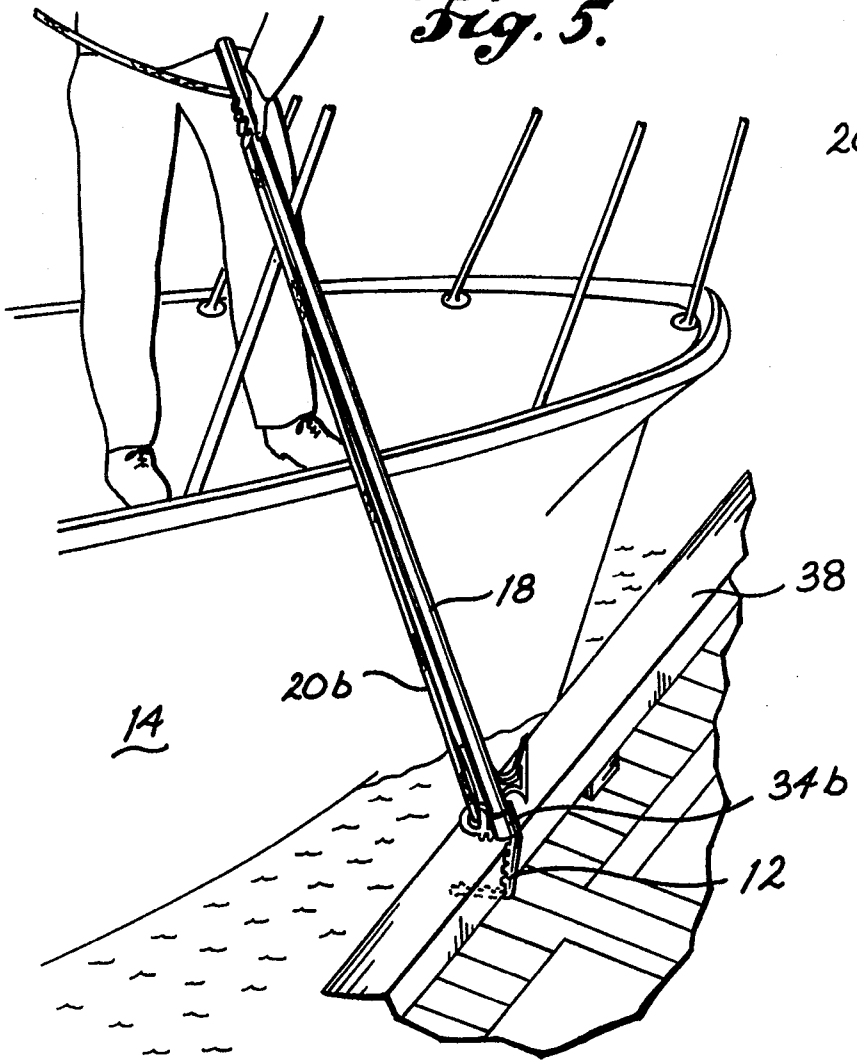
FIG. 5 is a perspective view illustrating the use of the dock hook.
Figure 6:
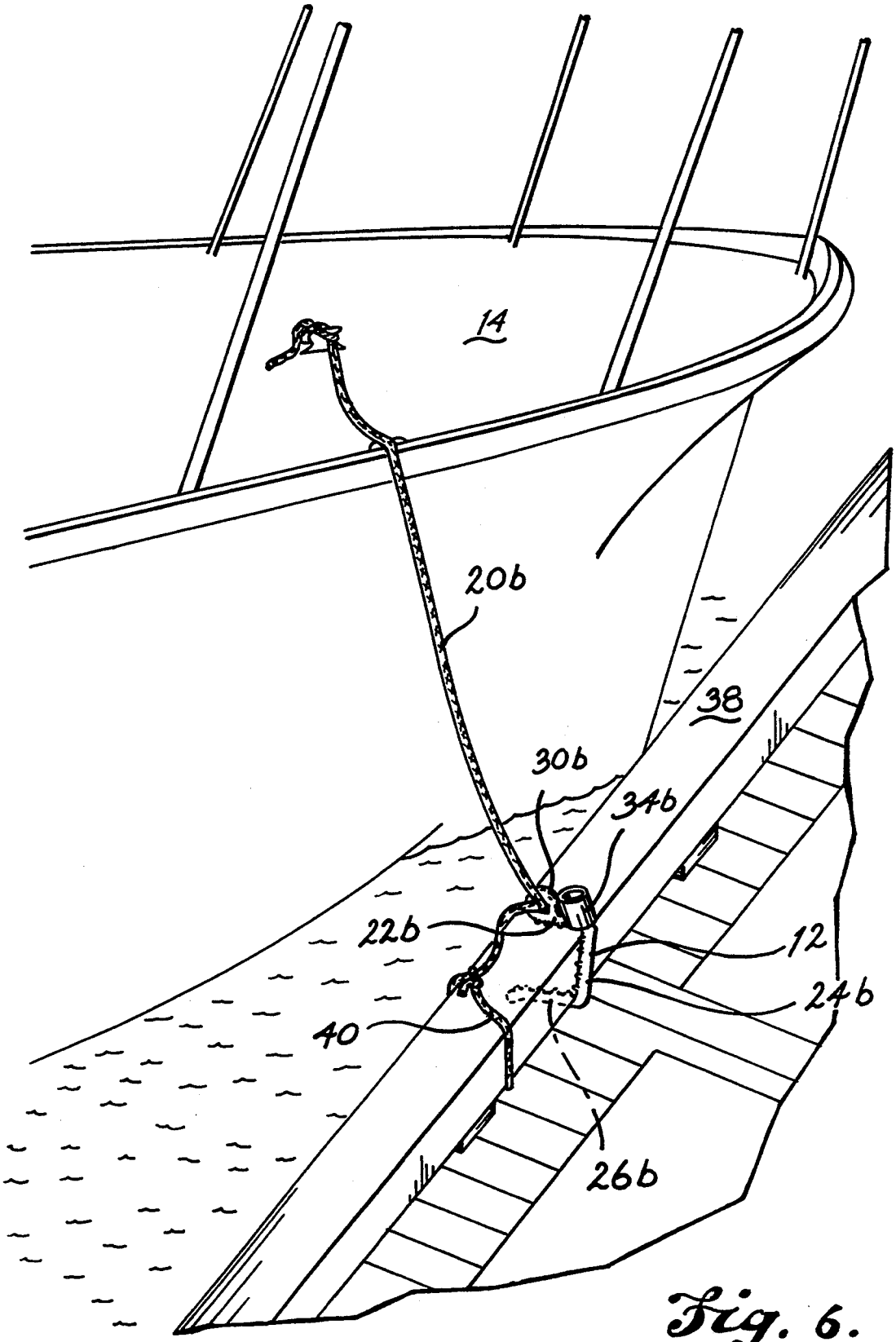
FIG. 6 is a perspective view of the dock hook embodiment of the present invention in a long-term moorage configuration.

Referring to FIG. 4, an alternate embodiment of the invention will now be discussed. This embodiment includes a dock hook 12 that also has a U-shape but which is designed for temporarily mooring boat 14 to a dock rail 38, as shown in FIG. 5. Dock hook 12 includes eye **30*b*, which is attached to eye splice 32*b* of mooring line 20*b*. Eye 30*b* is formed at the free end of top portion 22*b*. Tubular sleeve 34*b* is secured adjacent eye 30*b* on top portion 22*b*. As with buoy hook 10, sleeve 34*b* on dock hook 12 has a longitudinal axis that is generally transverse to the longitudinal axis of top portion 22*b*. Preferably, the acute angle between top portion 22*b* and sleeve 34*b* is between 45 degrees and 80 degrees. This angle facilitates the positioning of dock hook 12 with boat hook 18 since typically dock hook 12 will be extended away from boat 14 at an angle to reach dock rail 38. At the opposing end of top portion 22*b*, dock hook 12 bends approximately 90 degrees just after its attachment to sleeve 34*b* to form middle portion 24*b*. Middle portion 24*b* is substantially linear for about four inches where another approximate 90-degree bend forms bottom portion 26*b*. Bottom portion 26*b* is also substantially linear, except for a small downward curve in its midportion. Thus, a U-shape is formed that is sized to fit over a typical four-inch dock rail 38. Dock hook 12 also includes raised ribs 28*b* around its inside surfaces similar to ribs 28*a* on buoy hook 10**.

As seen in FIG. 5, dock hook 12 is used by inserting the end of boat hook 18 within sleeve **34*b*, maintaining tension on mooring line 20*b*, and sliding dock hook 12 into position around at least a portion of dock rail 38. Ribs 28*b* serve to increase the friction on dock rail 38** such that slippage is not likely to occur.

Attachment to dock rail 38 for long-term moorage is easily accomplished after disembarking by simply looping a permanent securing line 40 around dock rail 38. However, this does not need to be done until disembarking, the boat being at least temporarily secure with one or more dock hooks 12.

The space between the free ends of top portion **22*b* and bottom portion 26*b* (the gap) is only slightly greater than the thickness of dock rail 38. However, alternatively, this gap could be slightly smaller to provide a slight interference fit. Bottom portion 26*b* would flex away from top portion 22*b*** and provide a more secure attachment.

Dock hook 12 provides the advantage of being operable by one person. There are no moving pans and nothing to replace. Dock hook 12 is easy to use and there is no need to leave the boat while securing it.

While the preferred embodiments of the invention has been illustrated and described, it will be appreciated that various changes can be made therein without departing from the spirit and scope of the invention.

The embodiments of the invention in which an exclusive property or privilege is claimed are defined as follows:

1. An apparatus for mooring a boat to a mooring structure with the aid of a rod and a mooring line, the apparatus comprising:

(a) a one-piece U-shaped securing member arranged and configured for at least partially surrounding a portion of the mooring structure to provide moorage thereto, said securing member having a top portion with a first end and a bottom portion with a second end and an open side between the first and second ends, the distance between the first and second ends providing close-fitting engagement with the mooring structure;

(b) an attachment structure extending from the first end of said securing member, the mooring line being attached to said attachment structure; and (c) a rod-receiving structure having a longitudinal axis generally transverse to the longitudinal axis of said top portion of said U-shaped securing member, said rod-receiving structure being attached to said securing member adjacent said attachment structure for receiving the end of the rod and properly aligning said U-shaped securing member such that the open side faces the mooring structure.

2. The apparatus of claim 1, wherein the mooring structure includes a buoy ring, and wherein the distance between the first end and the second end is substantially the same as the thickness of the buoy ring.

3. The apparatus of claim 1, wherein the mooring structure includes a dock rail, and wherein the distance between the first end and the second end is substantially the same as the thickness of the dock rail, at least two sides of said U-shaped securing member being substantially parallel to and abutting at least two sides of the dock rail for close-fitting engagement therewith.

4. An apparatus for mooring a boat to a buoy having a buoy ring with the aid of a rod and a mooring line, the apparatus comprising:

(a) a one-piece U-shaped securing member having a top portion, a middle portion extending downwardly from the top portion, and a bottom portion extending back from the middle portion, the gap between the top portion and the bottom portion being substantially the same width as the thickness of the buoy ring for close-fitting engagement therewith;

(b) an eye extending from the top portion of said securing member, the mooring line being attached to said eye; and (c) a rod-receiving sleeve attached to the top portion of the securing member, said sleeve having an inner shape matching the outer shape of one end of the rod for removable engagement therewith, said sleeve having a central axis substantially transverse to the longitudinal axis of the top portion of the securing member.

5. The apparatus of claim 4, wherein said securing member further includes ribs projecting inwardly from at least one of the top, middle, and bottom portions of the securing member.

6. The apparatus of claim 4, wherein the bottom portion of the securing member includes a slight downward bend as it approaches the end of the top portion.

7. The apparatus of claim 4, wherein said sleeve is disposed adjacent said eye at the end of the top portion of the securing member opposite the middle portion.

8. The apparatus of claim 4, wherein the gap between the top and bottom portions is slightly narrower than the thickness of the buoy ring, the bottom portion of the securing member elastically bending slightly away from the top portion as the ring passes through the gap.

9. The apparatus of claim 10, wherein the bottom portion of the securing member includes a slight downward bend as it approaches the end of the top portion.

10. The apparatus of claim 9, wherein said securing member further includes ribs projecting inwardly from at least one of the top, middle, and bottom portions of the securing member.

11. An apparatus for mooring a boat to a dock rail with the aid of a rod and a mooring line, the apparatus comprising:

(a) a U-shaped securing member having a top portion, a middle portion extending downwardly from the top portion, and a bottom portion extending back from the middle portion, the gap between the top portion and the bottom portion being substantially the same width as the thickness of the dock rail for close-fitting engagement therewith, at least two of the top, middle, and bottom portions being substantially parallel to and abutting at least two sides of the dock rail;

(b) an eye extending from the top portion of said securing member, the mooring line being attached to said eye; and (c) a rod-receiving sleeve attached to the top portion of the securing member, said sleeve having an inner shape matching the outer shape of one end of the rod for removable engagement therewith, Said sleeve having a longitudinal axis generally transverse to the longitudinal axis of the top portion of said securing member.

12. The apparatus of claim 11, wherein said securing member further includes ribs projecting inwardly from the inside perimeter of the securing member.

13. The apparatus of claim 11, wherein said sleeve is disposed adjacent said eye at the end of the top portion of the securing member opposite the middle portion.

14. The apparatus of claim 11, wherein the gap between the top and bottom portions is slightly narrower than the thickness of the dock rail, the bottom portion of the securing member elastically bending slightly away from the top portion as the securing member is placed around the dock rail.

15. The apparatus of claim 14, wherein said securing member further includes ribs projecting inwardly from the inside perimeter of the securing member.

16. An apparatus for mooring a boat to a buoy having a buoy ring with the aid of a rod and a mooring line, the apparatus comprising (a) a U-shaped securing member having a top portion, a middle portion extending downwardly from the top portion, and a bottom portion extending back from the middle portion, the gap between the top portion and the bottom portion being substantially the same width as the thickness of the buoy ring for close-fitting engagement therewith;

(b) an eye extending from the top portion of said securing member, the mooring line being attached to said eye; and (c) a rod-receiving sleeve attached to the top portion of the securing member, said sleeve having an inner shape matching the outer shape of one end of the rod for removable engagement therewith, and wherein the longitudinal axis of said sleeve is substantially transverse to the longitudinal axis of the top portion of the securing member.

17. The apparatus of claim 16, wherein said sleeve is disposed adjacent said eye at the end of the top portion of said securing member opposite the middle portion.

18. The apparatus of claim 16, wherein the gap between the top and bottom portions is slightly narrower than the thickness of the buoy ring, the bottom portion of the securing member elastically bending slightly away from the top portion as the ring passes through the gap.

19. An apparatus for mooring a boat to a dock rail with the aid of a rod and a mooring line, the apparatus comprising:

(a) a U-shaped securing member having a top portion, a middle portion extending downwardly from the top portion, and a bottom portion extending back from the middle portion, the gap between the top portion and the bottom portion being substantially the same width as the thickness of the dock rail for close-fitting engagement therewith;

(b) an eye extending from the top portion of said securing member, the mooring line being attached to said eye; and (c) a rod-receiving sleeve attached to the top portion of the securing member, said sleeve having an inner shape matching the outer shape of one end of the rod for removable engagement therewith, wherein the longitudinal axis of said sleeve is substantially transverse to the longitudinal axis of the top portion of said securing member.

20. The apparatus of claim 19, wherein said sleeve is disposed adjacent said eye at the end of the top portion of the securing member opposite the middle portion.

21. The apparatus of claim 19, wherein the gap between the top and bottom portions is slightly narrower than the thickness of the dock rail, the bottom portion of the securing member elastically bending slightly away from the top portion as the securing member is placed around the dock rail.

22. An apparatus for mooring a boat to a mooring structure with the aid of a rod and a mooring line, the apparatus comprising:

(a) a U-shaped securing member arranged and configured for at least partially surrounding a portion of the mooring structure to provide moorage thereto, said securing member having a first end, a second end, and an open side between the first and second ends, the distance between the first and second ends providing close-fitting engagement with the mooring structure;

(b) an attachment structure extending from the first end of said securing member, the mooring line being attached to said attachment structure; and (c) a rod-receiving structure attached to said securing member adjacent said attachment structure for receiving the end of the rod and properly aligning said U-shaped securing member such that the open side faces the mooring structure, said U-shaped securing member having a longitudinal axis generally transverse to the open Side of said securing member, said rod-receiving structure having a longitudinal axis generally transverse to the longitudinal axis of said securing member.

* * * * *

UNITED STATES PATENT AND TRADEMARK OFFICE

CERTIFICATE OF CORRECTION

PATENT NO. : 5,381,749
DATED : January 17, 1995
INVENTOR(S) : V.A. Larson

It is certified that error appears in the above-indentified patent and that said Letters Patent is hereby corrected as shown below:

| COLUMN | LINE | |
|---|---|---|
| 1-2 | Abstract (Line 11) | "eve" should read --eye-- |
| 1-2 | Abstract (Line 15) | "eve." should read --eye.-- |
| 1 | 5 | "1. Field of the Invention" should read --Field of the Invention-- |
| 1 | 8 | "2. Background of the Invention" should read --Background of the Invention-- |
| 1 | 43 | "ting" should read --ring-- |
| 2 | 10 | "ting." should read --ring.-- |
| 2 | 13 | "ting." should read --ring.-- |

UNITED STATES PATENT AND TRADEMARK OFFICE

CERTIFICATE OF CORRECTION

PATENT NO. : 5,381,749

DATED : January 17, 1995

INVENTOR(S) : V. A. Larson

It is certified that error appears in the above-indentified patent and that said Letters Patent is hereby corrected as shown below:

| Column | Line | |
|---|---|---|
| 4 | 58 | "simpl" should read --simply-- |
| 4 | 68 | "tings" should read --rings-- |
| 5 | 49 | "pans" should read --parts-- |
| 7 (Claim 11, | 21 line 20) | "Said" should read --said-- |
| 8 (Claim 11, | 59 line 21)) | "Side" should read --side-- |

Signed and Sealed this

Twenty-fifth Day of April, 1995

*Attest:*

Bruce Lehman

BRUCE LEHMAN

*Attesting Officer*

*Commissioner of Patents and Trademarks*